US011741884B2

(12) United States Patent
Kim et al.

(10) Patent No.: US 11,741,884 B2
(45) Date of Patent: Aug. 29, 2023

(54) DISPLAY DEVICE WITH INTERNAL COMPENSATION

(71) Applicant: SAMSUNG DISPLAY CO., LTD., Yongin-si (KR)

(72) Inventors: Hyun Joon Kim, Yongin-si (KR); Jang Mi Kang, Yongin-si (KR); Hae Min Kim, Yongin-si (KR); Jun Hyun Park, Yongin-si (KR); Min Jae Jeong, Yongin-si (KR); Ki Hyun Pyo, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/323,213

(22) Filed: May 18, 2021

(65) Prior Publication Data

US 2022/0101777 A1 Mar. 31, 2022

(30) Foreign Application Priority Data

Sep. 25, 2020 (KR) ..... 10-2020-0125224

(51) Int. Cl.

| | |
|---|---|
| ***G09G 3/32*** | (2016.01) |
| ***G09G 3/3233*** | (2016.01) |
| ***G09G 3/3208*** | (2016.01) |
| ***G09G 3/30*** | (2006.01) |
| ***G09G 3/3225*** | (2016.01) |
| ***G09G 3/325*** | (2016.01) |

(52) U.S. Cl.

CPC ..... *G09G 3/32* (2013.01); *G09G 3/30* (2013.01); *G09G 3/325* (2013.01); *G09G 3/3208* (2013.01);

(Continued)

(58) Field of Classification Search

CPC ..... G09G 3/30; G09G 3/32; G09G 3/3208; G09G 3/3225; G09G 3/3233; G09G 3/325;

(Continued)

(56) References Cited

U.S. PATENT DOCUMENTS 6,229,506 B1 5/2001 Dawson et al.
8,917,225 B2 * 12/2014 Kang ..... G09G 3/3233 345/82

(Continued)

FOREIGN PATENT DOCUMENTS

CN 106710522 5/2017
CN 110070830 7/2019

(Continued)

*Primary Examiner* — Jason M Mandeville

(74) *Attorney, Agent, or Firm* — F. Chau & Associates, LLC

(57) ABSTRACT

A display device according to an embodiment of the present disclosure includes pixels connected to a first scan line, a second scan line, a third scan line, a data line, a first emission control line, and a second emission control line. Each of the pixels includes a light emitting element; a first transistor connected between a first node connected to a first power source and a second electrode connected to a second node connected to an anode of the light emitting element, and including a gate electrode connected to a third node; a second transistor connected between the data line and a fourth node and including a gate electrode connected to the first scan line; a first capacitor connected between the second node and a fifth node; a second capacitor connected between the fourth node and the fifth node; a fourth transistor connected between the third node and the fifth node, and including a gate electrode connected to the second scan line; and a sixth transistor connected between the third node and the fourth node, and including a gate electrode connected to the first emission control line.

18 Claims, 7 Drawing Sheets

(52) U.S. Cl.
CPC ..... *G09G 3/3225* (2013.01); *G09G 3/3233* (2013.01); *G09G 2300/0819* (2013.01); *G09G 2310/0267* (2013.01); *G09G 2320/0233* (2013.01); *G09G 2320/045* (2013.01)

(58) Field of Classification Search
CPC ... G09G 2310/0267; G09G 2300/0819; G09G 2320/0233; G09G 2320/045
USPC ..... 345/76
See application file for complete search history.

(56) References Cited

U.S. PATENT DOCUMENTS

| | | | | |
|---|---|---|---|---|
| 9,324,258 | B2 * | 4/2016 | Tsuge | G09G 3/30 |
| 9,552,767 | B2 * | 1/2017 | Miyake | G09G 3/3233 |
| 10,319,304 | B2 | 6/2019 | Kuang et al. | |
| 10,354,596 | B2 | 7/2019 | Zhang et al. | |
| 10,977,995 | B2 * | 4/2021 | Jinta | G09G 3/3266 |
| 2004/0174354 | A1 * | 9/2004 | Ono | G09G 3/3233 345/204 |
| 2009/0027310 | A1 * | 1/2009 | Kim | G09G 3/3233 345/76 |
| 2013/0162620 | A1 * | 6/2013 | Kim | G09G 3/3233 345/212 |
| 2016/0203794 | A1 * | 7/2016 | Lim | G09G 3/3225 345/77 |
| 2018/0122301 | A1 * | 5/2018 | Yoon | G09G 3/3258 |
| 2022/0028333 | A1 | 1/2022 | Jeong et al. | |

FOREIGN PATENT DOCUMENTS

| | | |
|---|---|---|
| KR | 10-1932744 | 12/2018 |
| KR | 10-2022-0014366 | 2/2022 |

* cited by examiner

DISPLAY DEVICE WITH INTERNAL COMPENSATION

CROSS-REFERENCE TO RELATED APPLICATION

This application claims priority under 35 U.S.C. § 119 to Korean Patent Application No. 10-2020-0125224, filed in the Korean Intellectual Property Office on Sep. 25, 2020, the entire contents of which are incorporated by reference.

TECHNICAL FIELD

The present disclosure generally relates to display devices, and more particularly relates to display device pixels with internal compensation.

DISCUSSION OF RELATED ART

With developments in information technology, the role of display devices, which may provide a connection medium between users and information, has been emphasized. In response to this, there has been increasing use of display devices such as liquid crystal display devices, organic light emitting display devices, and the like.

A display device may include pixels connected to scan lines and data lines, a scan driver for driving the scan lines, and a data driver for driving the data lines. Each pixel may include a pixel circuit including transistors, a capacitor, and a light emitting element. When a scan signal is supplied from a scan line, the pixel circuit may receive a data voltage from a data line and supply a current of a driving transistor to the light emitting element according to the data voltage. The light emitting element may emit light with an intensity corresponding to the current of the driving transistor.

In the presence of process deviation, deterioration, or the like, a desired pixel grayscale value might not be accurately implemented due to a deviation in electrical characteristics, such as such as a threshold voltage, of the driving transistor among the pixels. Thus, an internal compensation method might be used for compensating the deviation in electrical characteristics of the driving transistor inside the pixel, and/or an external compensation method might be used for compensating the deviation in electrical characteristics of the driving transistor outside the pixel.

SUMMARY

An internal compensation method may include setting a gate-source voltage of a driving transistor in a source-follower method. The source-follower internal compensation method may raise the source potential toward the gate potential while regulating the gate potential of the driving transistor to compensate for a deviation in electrical characteristics of the driving transistor.

In a source-follower type of pixel, when another capacitor is connected to a storage capacitor disposed between a gate electrode and a source electrode of the driving transistor, a voltage difference between the ends of the storage capacitor may be changed according to a capacitance ratio between the two capacitors. When the voltage difference decreases between the ends of the storage capacitor, a larger data voltage may be supplied to the pixel to implement the desired grayscale value.

An embodiment of the present disclosure provides a pixel capable of preventing loss or degradation of a data voltage due to capacitors. Another embodiment of the present disclosure provides a pixel capable of high-resolution and high-speed driving by sufficiently securing a period for compensating for a deviation in electrical characteristics such as a threshold voltage, of a driving transistor. However, embodiments of the present disclosure are not limited to the above-described embodiments, and may be variously adapted or extended without departing from the scope and spirit of the present disclosure.

A display device according to an embodiment of the present disclosure may include pixels connected to a first scan line, a second scan line, a third scan line, a data line, a first emission control line, and a second emission control line. Each of the pixels may comprise a light emitting element; a first transistor connected between a first node connected to a first power source and a second electrode connected to a second node connected to an anode of the light emitting element, and including a gate electrode connected to a third node; a second transistor connected between the data line and a fourth node and including a gate electrode connected to the first scan line; a first capacitor connected between the second node and a fifth node; a second capacitor connected between the fourth node and the fifth node; a fourth transistor connected between the third node and the fifth node, and including a gate electrode connected to the second scan line; and a sixth transistor connected between the third node and the fourth node, and including a gate electrode connected to the first emission control line. The display device may further include a third transistor connected between the third node and a third power source, and including a gate electrode connected to the second scan line. The display device may further include a fifth transistor connected between the second node and a fourth power source, and including a gate electrode connected to the third scan line. The display device may further include a seventh transistor connected between the first node and the first power source, and including a gate electrode connected to the second emission control line.

The display device may further include a non-emission period including an initialization period in which the second node is initialized by the fourth power source and the fifth node is initialized by the third power source, a compensation period in which a threshold voltage of the first transistor is compensated, and a data writing period in which a data voltage applied through the data line is supplied to the third node; and an emission period in which the light emitting element emits light in response to the data voltage. The data writing period may overlap the compensation period, and a voltage of the fifth node may be maintained by the third power source during the compensation period.

The first to seventh transistors may be N-type thin film transistors, a gate-on voltage may have a logic high level, and a gate-off voltage may have a logic low level. The third transistor and the fourth transistor may be maintained in a turned-on state during the initialization period, the compensation period, and the data writing period, and the fifth transistor may be turned on during the initialization period. The seventh transistor may be maintained in the turned-on state during the compensation period.

A voltage of the second node may converge to a voltage difference between the third power source and the threshold voltage of the first transistor, and a voltage difference between both ends of the first capacitor may correspond to the threshold voltage of the first transistor. The data writing period may overlap the compensation period, and the second transistor may be turned on during the data writing period.

A voltage difference between both ends of the second capacitor may be a difference value between the data voltage and the third power source.

During the emission period, the first capacitor and the second capacitor may be connected in series between the second node and the third node. During the emission period, the sixth transistor and the seventh transistor may be maintained in the turned-on state, and the fourth transistor may be maintained in a turned-off state. A cathode of the light emitting element may be connected to a second power source.

A pixel unit according to an embodiment of the present disclosure may include a plurality of pixels, each pixel comprising: a light emitting element including a cathode connected to a second power source; a first transistor including a first electrode, a second electrode connected to an anode of the light emitting element, and a gate electrode; a third transistor including a first electrode connected to a third power source, a second electrode connected to the gate electrode of the first transistor, and a gate electrode connected to a second scan line; a fourth transistor including a first electrode connected to the gate electrode of the first transistor, a second electrode, and a gate electrode connected to the second scan line; a first capacitor connected between the second electrode of the first transistor and the second electrode of the fourth transistor; and a seventh transistor including a first electrode connected to a first power source, a second electrode connected to the first electrode of the first transistor, and a gate electrode connected to a second emission control line. The gate electrode of the first transistor may connect the second electrode of the third transistor and the first electrode of the fourth transistor.

Each pixel may include a second transistor including a first electrode connected to a data line, a second electrode, and a gate electrode connected to a first scan line. Each pixel may include a second capacitor connected between the second electrode of the second transistor and the second electrode of the fourth transistor. Each pixel may include a fifth transistor including a first electrode connected to the second electrode of the first transistor, a second electrode connected to a fourth power source, and a gate electrode connected to a third scan line; and a sixth transistor including a first electrode connected to the gate electrode of the first transistor, a second electrode connected to the second electrode of the second transistor, and a gate electrode connected to a first emission control line. The first through seventh transistors may be P-type thin film transistors, a gate-on voltage may have a logic low level, and a gate-off voltage may have a logic high level.

BRIEF DESCRIPTION OF THE DRAWINGS

The accompanying drawings, which are included to provide further understanding of the inventive concept, are incorporated in and constitute a part of this specification, illustrate embodiments of the inventive concept, and, together with the description, serve to explain principles of the inventive concept.

DETAILED DESCRIPTION

Figure 1:
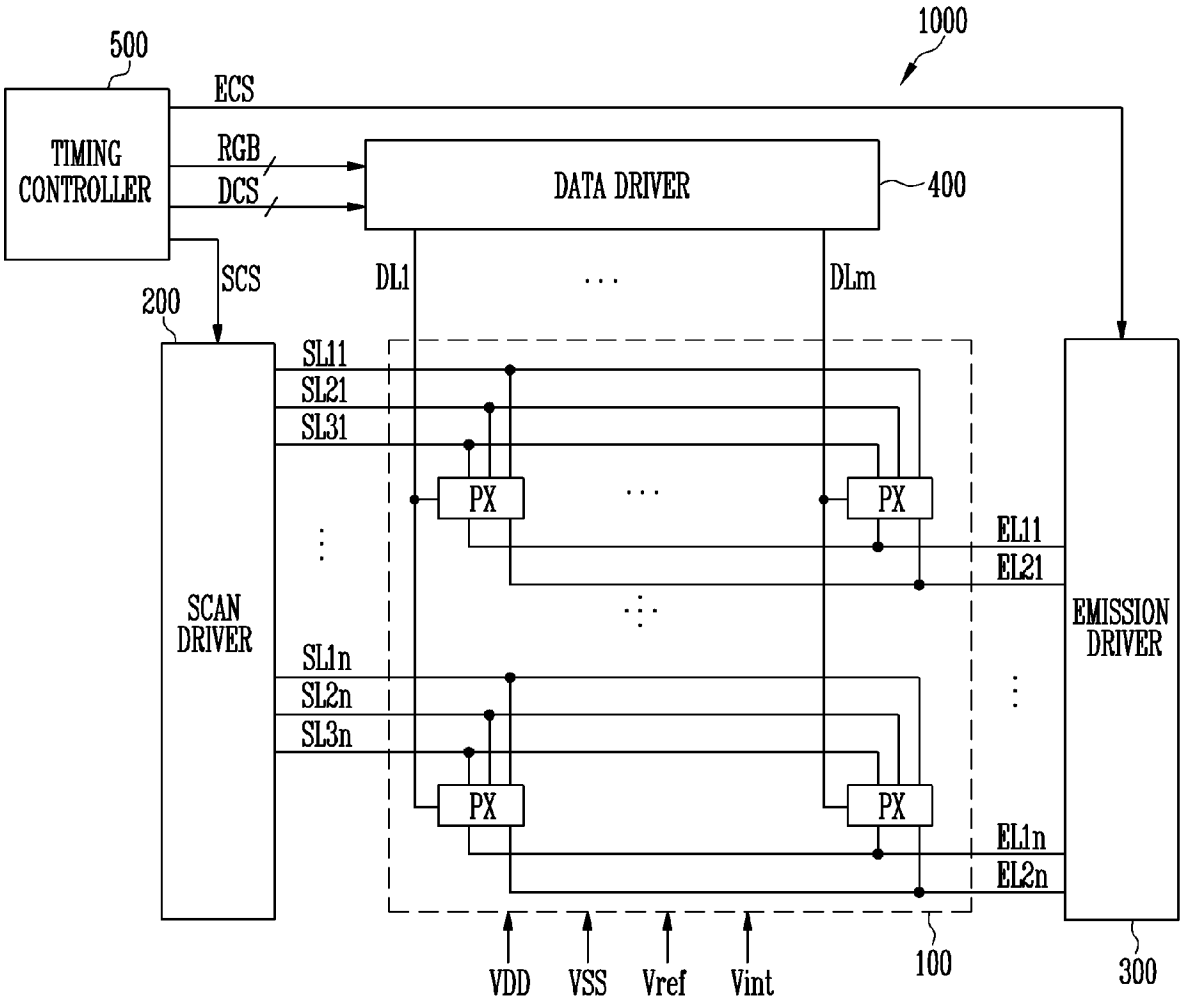
FIG. 1 is a block diagram illustrating a display device according to an embodiment of the present disclosure.

Embodiment of the present disclosure will be described in detail with reference to the accompanying drawings. The same or like reference numerals may be used for the same or like elements in the drawings, and duplicate descriptions for the same or like elements may be omitted.

FIG. 1 illustrates a display device according to an embodiment of the present disclosure.

Referring to FIG. 1, a display device 1000 may include a pixel unit 100, a scan driver 200, an emission driver 300, a data driver 400, and a timing controller 500. Each of the drivers and/or controller may be implemented as one or more circuits. Alternatively, one or more of the drivers and/or controller may be combined in an integrated circuit.

In an embodiment, the display device 1000 may further include a power supply unit for supplying voltages of a first power source VDD, a second power source VSS, a third power source Vref, and a fourth power source Vint to the pixel unit 100. However, this is an example, and at least one of the first power source VDD, the second power source VSS, the third power source Vref, or the fourth power source Vint may be supplied from the timing controller 500 or the data driver 400.

The pixel unit 100 may include a plurality of first scan lines SL11 to SL1*n*, a plurality of second scan lines SL21 to SL2*n*, a plurality of third scan lines SL31 to SL3*n*, a plurality of first emission control lines EL11 to EL1*n*, a plurality of second emission control lines EL21 to EL2*n*, a plurality of data lines DL1 to DLm, and a plurality (e.g., an n×m matrix) of pixels PX connected to the first scan lines SL11 to SL1*n*, the second scan lines SL21 to SL2*n*, the third scan lines SL31 to SL3*n*, the first emission control lines ELI1 to ELIn, the second emission control lines EL21 to EL2*n*, and the data lines DL1 to DLm, where n and m may be integers greater than 1. Each of the pixels PX may include a driving transistor and a plurality of switching transistors.

The scan driver 200 may sequentially supply scan signals to the pixels PX through the first scan lines SL11 to SL1*n*, the second scan lines SL21 to SL2*n*, and the third scan lines SL31 to SL3*n* based on a first control signal such as a scan control signal SCS. The scan driver 200 may receive the first control signal SCS, at least one clock signal, and the like from the timing controller 500.

In an embodiment, a scan signal supplied to one scan line in one frame period may include at least one scan pulse. For example, the scan signal may include a first scan signal SS1 sequentially supplied to the first scan lines SL11 to SL1*n*, a second scan signal SS2 sequentially supplied to the second scan lines SL21 to SL2*n*, and a third scan signal SS3 sequentially supplied to the third scan lines SL31 to SL3*n*.

The first scan signal SS1 may include at least one first scan pulse, the second scan signal SS2 may include at least one second scan pulse, and the third scan signal SS3 may include at least one third scan pulse. Here, the first scan pulse, the second scan pulse, and the third scan pulse may be a gate-on voltage for turning on transistors included in the pixels PX. For example, when the transistors included in the pixels PX are P-channel metal oxide semiconductor (PMOS) transistors (e.g., P-type), the gate-on voltage may be set to a logic low level, and a gate-off voltage may be set to a logic high level. When the transistors included in the pixels PX are N-channel metal oxide semiconductor (NMOS) transistors (e.g., N-type), the gate-on voltage may be set to the logic high level, and the gate-off voltage may be set to the logic low level. In an alternate embodiment, some of the transistors may be N-type and others may be P-type, without limitation thereto.

In an embodiment, the scan driver 200 may include first stages dependently connected to each other in order to sequentially output the first scan signal SS1 including first scan pulses to the first scan lines SL11 to SL1*n*, second stages dependently connected to each other in order to sequentially output the second scan signal SS2 including second scan pulses to the second scan lines SL21 to SL2*n*, and third stages dependently connected to each other in order to sequentially output the third scan signal SS3 including third scan pulses to the third scan lines SL31 to SL3*n*.

The emission driver 300 may sequentially supply emission control signals to the pixels PX through the first emission control lines EL11 to EL1*n* and the second emission control lines EL21 to EL2*n* based on a second control signal such as an emission control signal ECS. The emission driver 300 may receive the second control signal ECS, a clock signal, and the like from the timing controller 500. Each emission control signal may divide one frame period into an emission period and a non-emission period for the pixels positioned on the same horizontal line or row.

In an embodiment, the emission control signal may include a first emission control signal EM1 sequentially supplied to the first emission control lines EL11 to EL1*n* and a second emission control signal EM2 sequentially supplied to the second emission control lines EL21 to EL2*n*.

The data driver 400 may receive a third control signal such as a data control signal DCS and image data such as red-green-blue RGB from the timing controller 500. The data driver 400 may supply data signals, such as data voltages, to the pixels PX through the data lines DL1 to DLm based on the third control signal DCS and the image data RGB. In an embodiment, the data driver 400 may supply the data signals corresponding to a grayscale value of an image to the data lines DL1 to DLm. For example, a data signal of a corresponding pixel PX may be supplied to the corresponding pixel PX in synchronization with each first scan signal SS1 including a first scan pulse.

The timing controller 500 may control driving of the scan driver 200, the emission driver 300, and the data driver 400 based on timing signals supplied from the outside. The timing controller 500 may supply a control signal including the first control signal SCS, a scan clock signal, and the like to the scan driver 200, and may supply a control signal including the second control signal ECS, an emission control clock signal, and the like to the emission driver 300. The third control signal DCS that controls the data driver 400 may include a source start signal, a source output enable signal, a source sampling clock, and the like.

Figure 2:
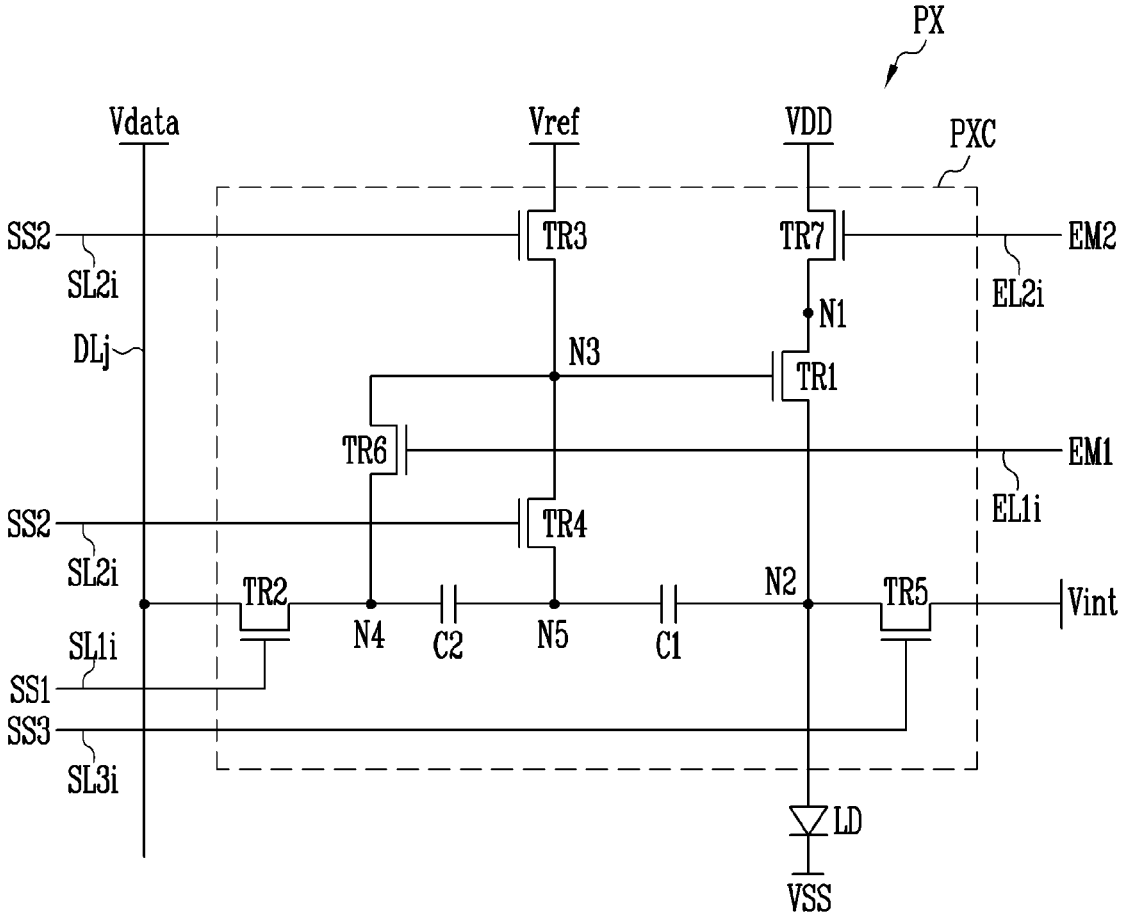
FIG. 2 is a circuit diagram for explaining a pixel according to an embodiment of the present disclosure.

FIG. 2 illustrates a pixel according to an embodiment of the present disclosure. For convenience of explanation, a pixel arranged in an i-th row and a j-th column will be described as an example, where i and j may be natural numbers greater than 1.

Referring to FIGS. 1 and 2, a pixel PX may include a pixel circuit PXC and a light emitting element LD connected to the pixel circuit PXC. The pixel circuit PXC may control the amount of current flowing from the first power source VDD to the second power source VSS via the light emitting element LD in response to a data voltage Vdata. The first power source VDD may be set to a voltage higher than the second power source VSS. An anode of the light emitting element LD may be connected to the pixel circuit PXC, and a cathode electrode may be connected to the second power source VSS. The light emitting element LD may generate light with a predetermined luminance in response to the amount of current supplied from the pixel circuit PXC.

In an alternate embodiment, the anode of the light emitting element LD may be connected to the first power source VDD, and the cathode electrode may be connected to the pixel circuit PXC.

The pixel circuit PXC according to an embodiment may include first to seventh transistors TR1 to TR7, a first capacitor C1 and a second capacitor C2.

The first transistor TR1 may include a first electrode connected to a first node N1, a second electrode connected to a second node N2, and a gate electrode connected to a third node N3. The first electrode may be connected to the first power source VDD via the seventh transistor TR7, and the second electrode may be connected to the anode of the light emitting element LD. The gate electrode may be connected to a data line DL via the second transistor TR2 and the sixth transistor TR6.

According to an embodiment, the first electrode may be a drain electrode of the first transistor TR1, and the second electrode may be a source electrode of the first transistor TR1. The first transistor TR1 may supply a driving current corresponding to a voltage of the third node N3, such as the gate electrode, to the light emitting element LD. That is, the first transistor TR1 may function as a driving transistor of the pixel PX.

The second transistor TR2 may include a first electrode connected to a j-th data line DLj, a second electrode connected to a fourth node N4, and a gate electrode connected to a first i-th scan line SL1*i*. The gate electrode may receive the first scan signal SS1 through the first i-th scan line SL1*i*. When the second transistor TR2 is turned on by the first scan signal SS1, the data voltage Vdata may be transmitted to the fourth node N4.

The third transistor TR3 may include a first electrode connected to the third power source Vref, a second electrode connected to the third node N3, and a gate electrode connected to a second i-th scan line SL2*i*. The gate electrode may receive the second scan signal SS2 through the second i-th scan line SL2*i*. When the third transistor TR3 is turned on by the second scan signal SS2, the third power source Vref may be transmitted to the third node N3. In this case, the third power source Vref may be set to a specific voltage having a substantially DC component.

The fourth transistor TR4 may include a first electrode connected to the third node N3, a second electrode connected to a fifth node N5, and a gate electrode connected to the second i-th scan line SL2*i*. The gate electrode may receive the second scan signal SS2 through the second i-th scan line SL2*i*. When the fourth transistor TR4 is turned on by the second scan signal SS2, the voltage of the third node N3, such as the third power source Vref, may be transmitted to the fifth node N5.

The fifth transistor TR5 may include a first electrode connected to the second node N2, a second electrode connected to the fourth power source Vint, and a gate electrode connected to a third i-th scan line SL3*i*. The gate electrode may receive the third scan signal SS3 through the third i-th scan line SL3*i*. When the fifth transistor TR5 is turned on by the third scan signal SS3, the fourth power source Vint may be transmitted to the second node N2. In this case, the fourth power source Vint may be a ground voltage. However, the fourth power source Vint is not limited thereto, and may be set to a specific voltage having a substantially DC component, like the third power source Vref.

The sixth transistor TR6 may include a first electrode connected to the fourth node N4, a second electrode connected to the third node N3, and a gate electrode connected to a first i-th emission control line EL1*i*. The gate electrode may receive the first emission control signal EM1 through the first i-th emission control line EL1*i*. When the sixth transistor TR6 is turned on by the first emission control signal EM1, a voltage of the fourth node N4, such as the data voltage Vdata, may be transmitted to the third node N3.

The seventh transistor TR7 may include a first electrode connected to the first power source VDD, a second electrode connected to the first node N1, and a gate electrode connected to a second i-th emission control line EL2*i*. The gate electrode may receive the second emission control signal EM2 through the second i-th emission control line EL2*i*. When the seventh transistor TR7 is turned on by the second emission control signal EM2, the first power source VDD may be transmitted to the first node N1.

The first capacitor C1 may be connected between the second node N2 and the fifth node N5. In this case, the fifth node N5 may be connected to the gate electrode of the first transistor TR1 via the fourth transistor TR4. That is, the first capacitor C1 may be connected between the gate electrode and the source electrode, such as the second electrode, of the first transistor TR1. The first capacitor C1 may store a voltage difference between a voltage of the second node N2 and the voltage of the third node N3 that changes according to the operation timing of the pixel PX.

The second capacitor C2 may be connected between the fourth node N4 and the fifth node N5. In this case, the fourth node N4 may be connected to the j-th data line DLj via the second transistor TR2. That is, the second capacitor C2 may be connected between the j-th data line DLj and the fifth node N5. The second capacitor C2 may store the data voltage Vdata, such as the data voltage, applied through the j-th data line DLj. Thereafter, when the sixth transistor TR6 is turned on, the data voltage Vdata may be provided to the third node N3, such as the gate electrode of the first transistor TR1.

The light emitting element LD may be connected between the second node N2 and the second power source VSS. The cathode of the light emitting element LD may receive the second power source VSS. The first power source VDD and the second power source VSS may have different potentials. As an example, the first power source VDD may be set as a high-potential power source, and the second power source VSS may be set as a low-potential power source. In this case, a potential difference between the first and second power sources VDD and VSS may be set to be greater than or equal to a threshold voltage of the light emitting element LD during the emission period of the pixel PX.

Figure 3:
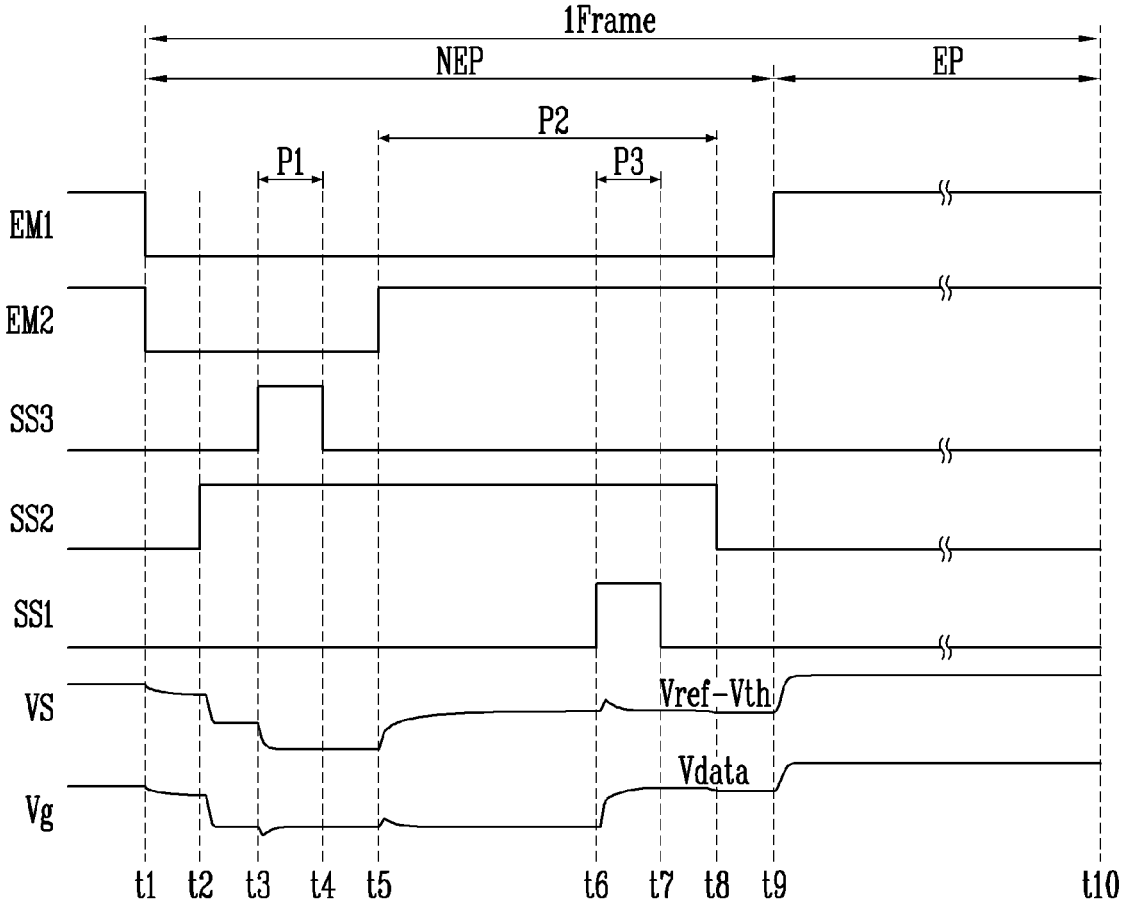
FIG. 3 is a timing diagram illustrating an example of a driving signal supplied to the pixel of FIG. 2.

FIG. 3 illustrates an example of a driving signal supplied to the pixel of FIG. 2.

Referring to FIGS. 1, 2 and 3, one frame period of the display device 1000 may include an emission period EP and a non-emission period NEP. In this case, although the non-emission period NEP included in one frame period is shown to be longer than the emission period EP, it should be understood that the length of the emission period EP may actually be longer than the length of the non-emission period NEP.

The non-emission period NEP may be a period from a first time point t1 to a ninth time point t9, and may be defined as a period in which the pixel PX does not substantially emit light. The emission period EP may be a period from the ninth time point t9 to a time point before the next frame starts, and may be defined as a period in which the pixel PX substantially emits light in response to the received data signal.

The non-emission period NEP of the display device 1000 may include an initialization period P1 for initializing the source electrode, such as the second electrode, and the gate electrode of the first transistor TR1 during the non-emission period NEP, a compensation period P2 for compensating electrical characteristics such as a threshold voltage Vth, of the first transistor TR1, and a data writing period P3 for writing the data signal to the gate electrode of the first transistor TR1. In this case, the initialization period P1 may correspond to a period from a third time point t3 to a fourth time point t4, the compensation period P2 may correspond to a period from a fifth time point t5 to an eighth time point t8, and the data writing period P3 may correspond to a period from a sixth time point t6 to a seventh time point t7, respectively.

According to an embodiment of the present disclosure, in the initialization period P1, the gate electrode of the first transistor TR1 may be initialized by the third power source Vref, and the source electrode, such as the second electrode, may be initialized by the fourth power source Vint.

In the compensation period P2, a voltage Vs of the source electrode, such as the second electrode, of the first transistor TR1 may converge to a difference value between the third power source Vref and the threshold voltage Vth of the first transistor TR1, that is, Vs=Vref−Vth. At this time, since a voltage Vg of the gate electrode of the first transistor TR1 may correspond to the third power source Vref, the threshold voltage Vth of the first transistor TR1 may be stored in the first capacitor C1.

In the data writing period P3, the data voltage Vdata corresponding to the data signal may be stored in the second capacitor C2.

In the emission period EP, a predetermined current may be supplied from the first transistor TR1 to the light emitting element LD in response to the voltage Vg of the gate electrode, such as the third node N3, of the first transistor TR1. In this case, the light emitting element LD may generate light with a predetermined luminance in response to the amount of current supplied from the first transistor TR1.

A detailed operation of the pixel PX in each of the periods P1, P2, P3, and EP may be described further below with reference to FIGS. 4 to 7.

Figure 4:
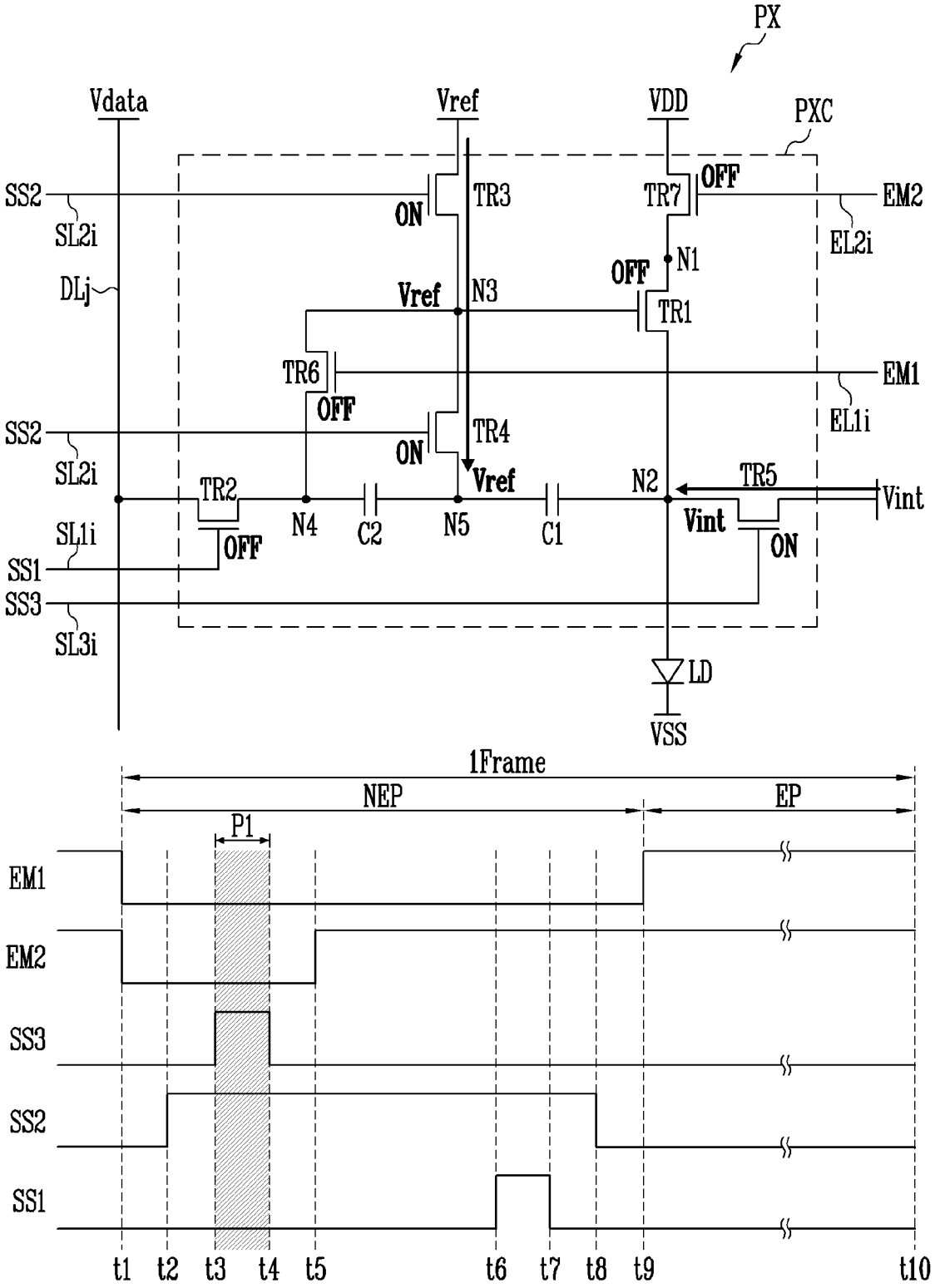
FIG. 4 is a hybrid circuit and timing diagram for explaining an operation of the pixel in an initialization period.

FIG. 4 illustrates an operation of the pixel in an initialization period.

Referring to FIG. 4, in the initialization period P1, the first emission control signal EM1 and the second emission control signal EM2 may each have a logic low level, the first scan signal SS1 may have the logic low level, the second scan signal SS2 may have a logic high level, and the third scan signal SS3 may be changed from the logic low level to the logic high level. Accordingly, the first capacitor C1 may be initialized by the third power source Vref and the fourth power source Vint.

Specifically, since the third transistor TR3 and the fourth transistor TR4 are in a turned-on state during the initialization period P1, the third power source Vref may be supplied to the third node N3 and the fifth node N5. In addition, since the fifth transistor TR5 is in the turned-on state during the initialization period P1, the fourth power source Vint may be supplied to the second node N2. As a result, the first capacitor C1 may be initialized by a voltage corresponding to the difference between the third power source Vref and the fourth power source Vint. In this case, since the sixth transistor TR6 and the seventh transistor TR7 are in a turned-off state during the initialization period P1, the light emitting element LD may maintain a non-emission state.

Figure 5:
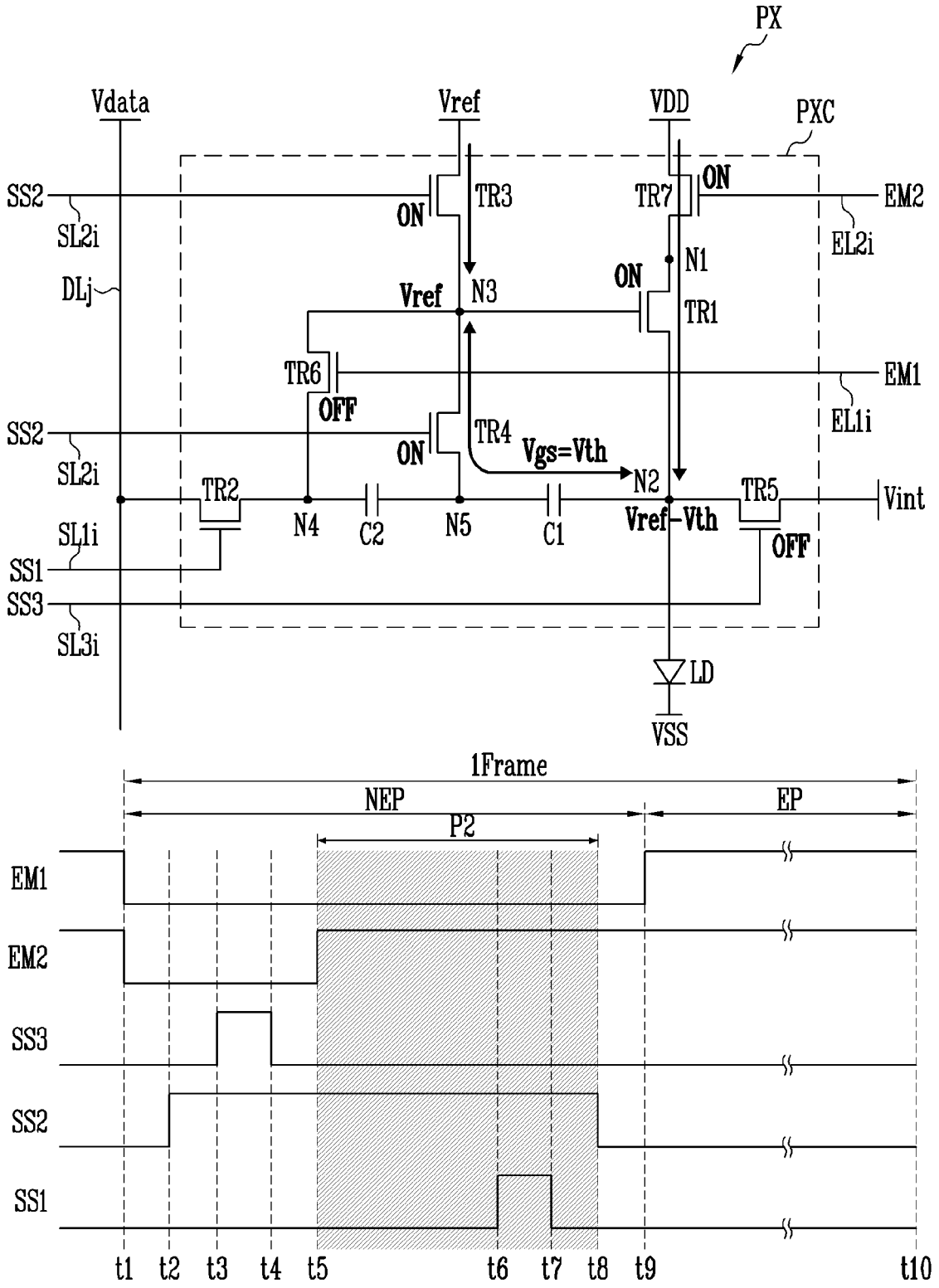
FIG. 5 is a hybrid circuit and timing diagram for explaining an operation of the pixel in a compensation period.

FIG. 5 illustrates an operation of the pixel in a compensation period.

Referring to FIG. 5, in the compensation period P2, the first emission control signal EM1 may have the logic low level, the second emission control signal EM2 may be changed from the logic low level to the logic high level, the first scan signal SS1 may have the logic low level, the second scan signal SS2 may have the logic high level, and the third scan signal SS3 may have the logic low level. Accordingly, a voltage corresponding to the threshold voltage Vth of the first transistor TR1 may be stored in the first capacitor C1 by the first power source VDD and the third power source Vref.

Specifically, while the first transistor TR1 is turned on, the fifth transistor TR5 may be turned off, and the third transistor TR3 and the fourth transistor TR4 may be maintained in the turned-on state. Accordingly, the third power source Vref may be supplied to the third node N3, such as the gate electrode of the first transistor TR1, and the second node N2, such as the source electrode of the first transistor TR1, may be electrically floated by the fifth transistor TR5 turned off. Accordingly, the first transistor TR1 may be turned on by the third power source Vref of the third node N3, such as the gate electrode of the first transistor TR1, to operate as a source-follower, and may be turned off when a source voltage is a voltage Vref-Vth obtained by subtracting the threshold voltage Vth of the first transistor TR1 from the third power source Vref, and thus a voltage, such as compensation voltage, corresponding to the threshold voltage Vth of the first transistor TR1 may be charged in the first capacitor C1. That is, the first capacitor C1 may be charged with a voltage equal to the difference between the third power source Vref and the threshold voltage Vth of the first transistor TR1 or a voltage close to the threshold voltage Vth of the first transistor TR1.

Figure 6:
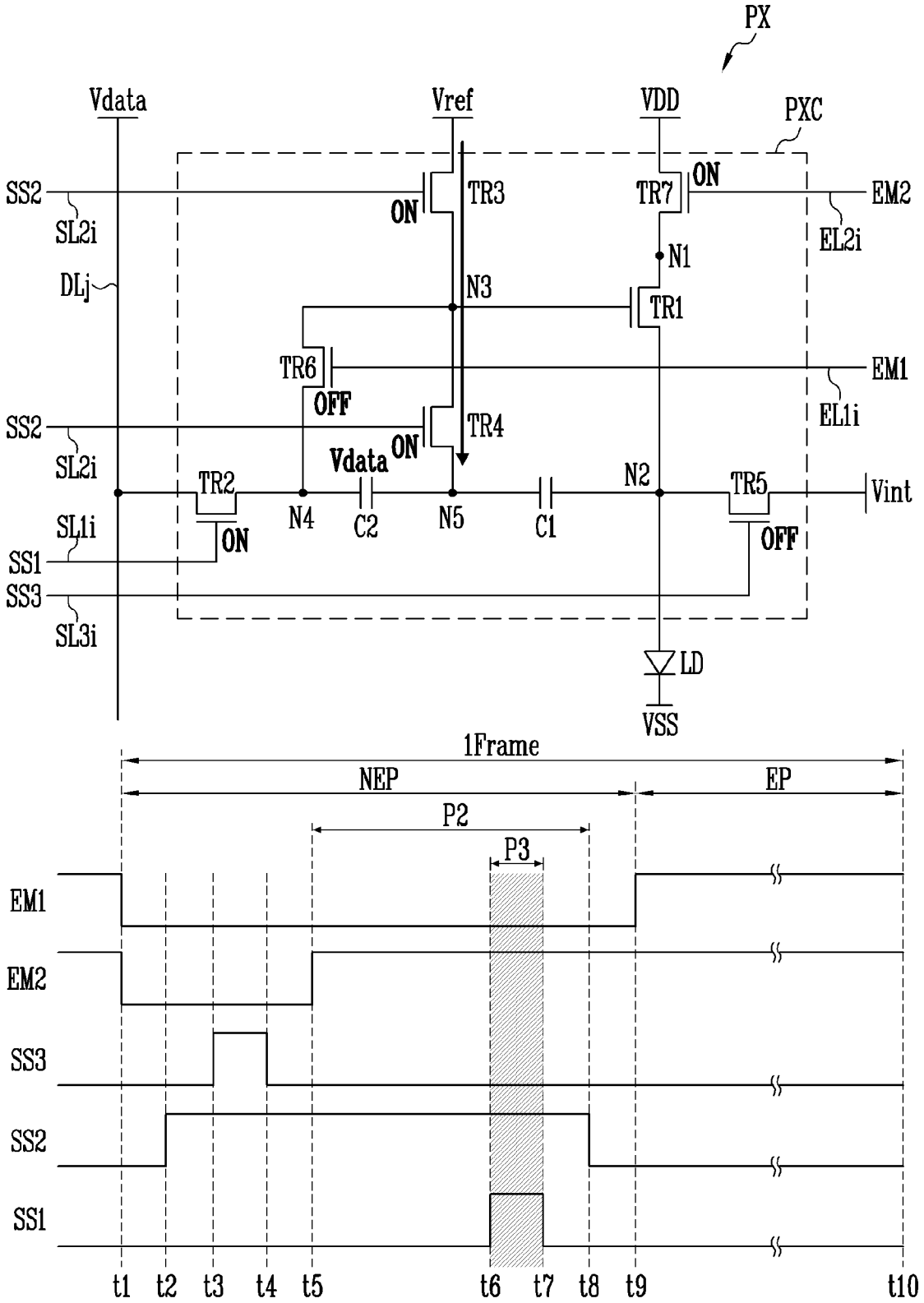
FIG. 6 is a hybrid circuit and timing diagram for explaining an operation of the pixel in a data writing period.

FIG. 6 illustrates an operation of the pixel in a data writing period.

Referring to FIG. 6, in the data writing period P3, the first emission control signal EM1 may have the logic low level, the second emission control signal EM2 may have the logic high level, the first scan signal SS1 may be changed from the logic low level to the logic high level, the second scan signal SS2 may have the logic high level, and the third scan signal SS3 may have the logic low level. Accordingly, the data voltage Vdata may be stored in the second capacitor C2.

Specifically, since the third transistor TR3 and the fourth transistor TR4 are in the turned-on state during the data writing period P3, the third power source Vref may still be supplied to the fifth node N5. In addition, since the sixth transistor TR6 is in the turned-off state during the data writing period P3, the third node N3 and the fourth node N4 may be electrically open. Since the second transistor TR2 is in the turned-on state, the data voltage Vdata received through the j-th data line may be supplied to the fourth node N4. That is, the second capacitor C2 may be charged with a voltage equal to the difference between the third power source Vref and the voltage of the fourth node N4 or a voltage close to the data voltage Vdata.

In this way, the data writing period P3 overlaps the compensation period P2, but the compensation operation and the data writing operation can be separated by continuously supplying the third power source Vref to an intermediate node between the first capacitor C1 and the second capacitor C2 connected in series during the compensation period P2. That is, since the fifth node N5 functions as a ground node, the threshold voltage Vth of the first transistor TR1 can be compensated through the first capacitor C1, and at the same time, the data voltage Vdata can be written through the second capacitor C2. Accordingly, since the pixel PX according to an embodiment of the present disclosure can secure a sufficient compensation period P2, an effect of driving the display device 1000 at high-resolution and high-speed can be expected.

Figure 7:
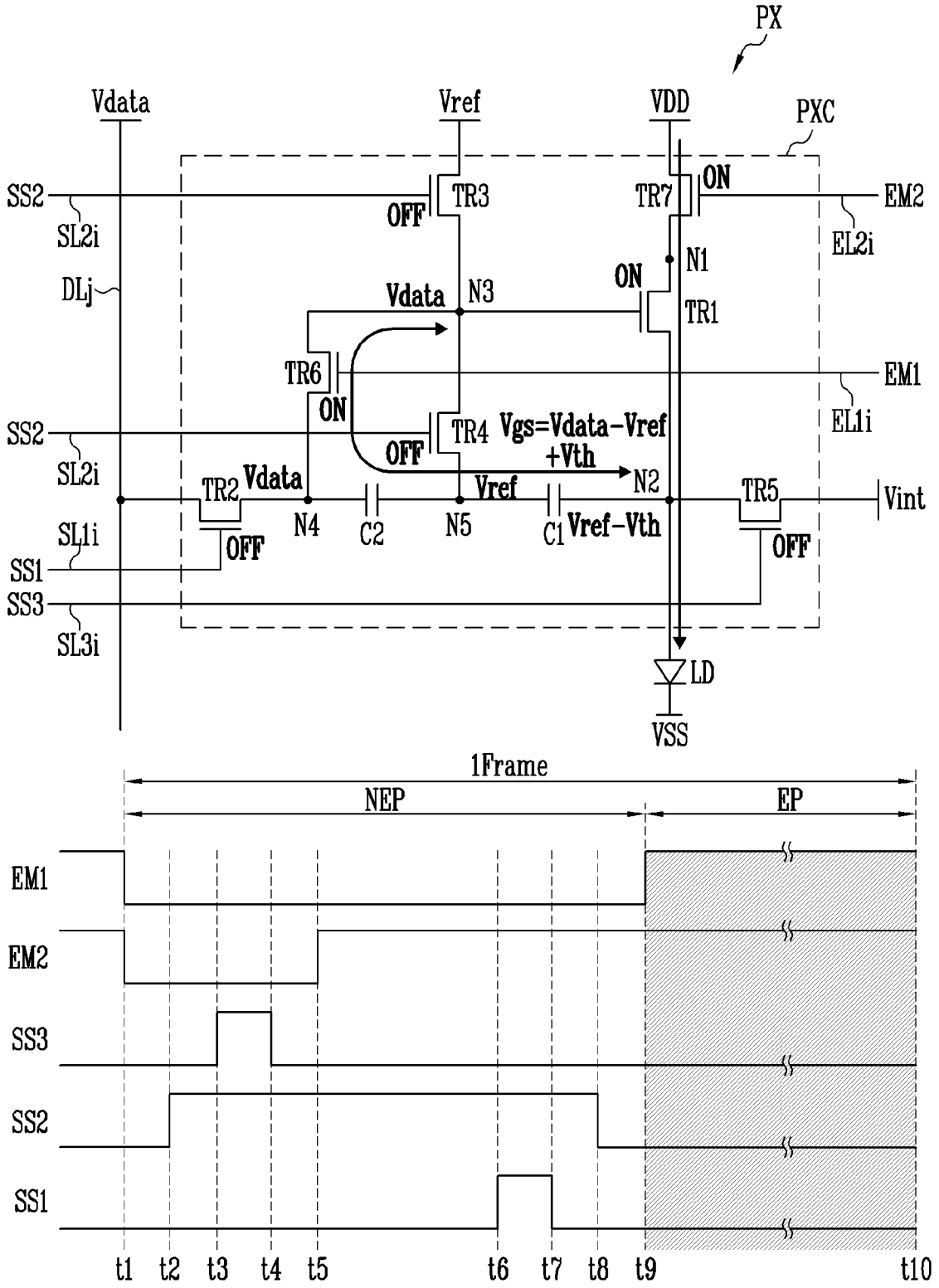
FIG. 7 is a hybrid circuit and timing diagram for explaining an operation of the pixel in an emission period.

FIG. 7 illustrates an operation of the pixel in an emission period.

Referring to FIG. 7, in the emission period EP, the first emission control signal EM1 and the second emission control signal EM2 may have the logic high level, and the first scan signal SS1, the second scan signal SS2, and the third scan signal SS3 may have the logic low level. Accordingly, the light emitting element LD may emit light by the first power source VDD and voltages of the first and second capacitors C1 and C2.

Since the sixth transistor TR6 is in the turned-on state during the emission period EP, the data voltage Vdata stored in the second capacitor C2 may be supplied to the third node N3, such as the gate electrode of the first transistor TR1. In addition, since the seventh transistor TR7 is in the turned-on state, the first power source VDD may be supplied to the first node N1, such as the drain electrode of the first transistor TR1. Then, the first transistor TR1 may control the amount of current flowing from the first power source VDD to the second power source VSS via the light emitting element LD in response to the voltage of the third node N3, such as the gate electrode of the first transistor TR1. Accordingly, during the emission period EP, the light emitting element LD may generate light with a predetermined luminance in response to the amount of current supplied from the first transistor TR1. A current Ids supplied from the first transistor TR1 to the light emitting element LD during the emission period EP may be set as shown in the following equation. In this case, the voltage Vg of the gate electrode of the first transistor TR1 may be Vdata [V], and the voltage Vs of the source electrode may be Vref−Vth [V].

$$Ids=k(Vgs-Vth)^2=k(Vdata-(Vref-Vth)-Vth)^2=k(Vdata-Vref)^2 \quad \text{[Equation 1]}$$

Here, k denotes a constant, and Vgs denotes a gate-source voltage of the first transistor TR1, which is a voltage difference between the voltage Vg of the gate electrode and the voltage Vs of the source electrode of the first transistor TR1.

Referring to the above equation, the current Ids supplied from the first transistor TR1 to the light emitting element LD may be determined in correspondence with the difference voltage between the data voltage Vdata and the third power source Vref. Since the third power source Vref is a fixed voltage, the current Ids supplied to the light emitting element LD may be determined corresponding to the data voltage Vdata.

As shown in the equation, the current Ids supplied to the light emitting element LD may be determined regardless of the first power source VDD and the threshold voltage Vth of the first transistor TR1. Accordingly, in the present disclosure, the current Ids may be supplied to the light emitting element LD regardless of a voltage drop of the first power source VDD and a deviation in the threshold voltage Vth of the first transistor TR1. Accordingly, reliability of the display quality of the display device 1000 can be ensured.

In addition, during the emission period EP, since the first capacitor C1 and the second capacitor C2 are connected in series between the second node N2, such as the source electrode of the first transistor TR1, and the third node N3, such as the gate electrode of the first transistor TR1, a phenomenon in which the gate-source voltage Vgs of the first transistor TR1 is changed according to the capacitance ratio between the capacitors can be prevented. That is, loss of the data voltage Vdata can be prevented.

As a result, since there is no need to supply a larger data voltage Vdata to the pixel PX to compensate for the lost data voltage Vdata (that is, since the data swing range does not increase), an effect of reducing power consumption required to drive the display device 1000 may be realized.

In the pixel according to embodiment an embodiment of the present disclosure, loss of the data voltage due to the capacitors can be prevented by applying a reference voltage having the DC component to the intermediate node of the capacitors connected in series.

According to embodiment an embodiment of the present disclosure, the pixel may be implemented with N-type thin film transistors, and the reference voltage having the DC component may be applied to the intermediate node of the capacitors connected in series. Therefore, high-resolution and high-speed driving can be implemented by sufficiently securing a period for compensating for a deviation in electrical characteristics, such as the threshold voltage, of the driving transistor.

However, effects according to the present disclosure are not limited to the above-described effects, and may be variously extended without departing from the spirit and scope of the present disclosure. For example, in an alternate embodiment, the first through seventh transistors may be P-type thin film transistors, a gate-on voltage may have a logic low level, and a gate-off voltage may have a logic high level.

Embodiments of the present disclosure have been described above with reference to the drawings. However, those of ordinary skill in the pertinent art to which the present disclosure pertains will appreciate that various modifications and changes can be made to the disclosed embodiments without departing from the scope and spirit of the present inventive concept as set forth in the following claims.

What is claimed is:

1. A display device comprising:

pixels connected to a first scan line, a second scan line, a third scan line, a data line, a first emission control line, and a second emission control line, wherein each of the pixels comprises:

a light emitting element;

a first transistor connected between a first node coupled to a first power source and a second node coupled to an anode of the light emitting element, and including a gate electrode connected to a third node;

a second transistor directly connected between the data line and a fourth node, and including a gate electrode connected to the first scan line;

a first capacitor connected between the second node and a fifth node;

a second capacitor connected between the fourth node and the fifth node;

a third transistor directly connected between the third node and a third power source, and including a gate electrode directly connected to the second scan line;

a fourth transistor directly connected between the third node and the fifth node, and including a gate electrode connected to the second scan line; and a sixth transistor connected between the third node and the fourth node, and including a gate electrode connected to the first emission control line.

2. The display device of claim 1, further comprising:

a fifth transistor connected between the second node and a fourth power source, and including a gate electrode connected to the third scan line.

3. The display device of claim 2, further comprising:

a seventh transistor connected between the first node and the first power source, and including a gate electrode connected to the second emission control line.

4. The display device of claim 3, further comprising:

a non-emission period including an initialization period in which the second node is initialized by the fourth power source and the fifth node is initialized by the third power source, a compensation period in which a threshold voltage of the first transistor is compensated, and a data writing period in which a data voltage applied through the data line is supplied to the third node; and an emission period in which the light emitting element emits light in response to the data voltage.

5. The display device of claim 4, wherein the data writing period overlaps the compensation period, and wherein a voltage of the fifth node is maintained by the third power source during the compensation period.

6. The display device of claim 4, wherein the first to seventh transistors are N-type thin film transistors, a gate-on voltage has a logic high level, and a gate-off voltage has a logic low level.

7. The display device of claim 4, wherein the seventh transistor is maintained in a turned-on state during the compensation period.

8. The display device of claim 7, wherein a voltage of the second node converges to a voltage difference between the third power source and the threshold voltage of the first transistor, and wherein a voltage difference between both ends of the first capacitor corresponds to the threshold voltage of the first transistor.

9. The display device of claim 8, wherein the data writing period overlaps the compensation period, and wherein the second transistor is turned on during the data writing period.

10. The display device of claim 9, wherein a voltage difference between both ends of the second capacitor is a difference value between the data voltage and the third power source.

11. The display device of claim 4, wherein during the emission period, the first capacitor and the second capacitor are connected in series between the second node and the third node.

12. The display device of claim 11, wherein during the emission period, the sixth transistor and the seventh transistor are maintained in a turned-on state, and the fourth transistor is maintained in a turned-off state.

13. The display device of claim 1, wherein a cathode of the light emitting element is connected to a second power source.

14. A pixel unit comprising a plurality of pixels, each pixel comprising:

a light emitting element including a cathode connected to a second power source;

a first transistor including a first electrode, a second electrode connected to an anode of the light emitting element, and a gate electrode;

a second transistor including a first electrode connected to a data line, a second electrode, and a gate electrode connected to a first scan line;

a third transistor including a first electrode directly connected to a third power source, a second electrode directly connected to the gate electrode of the first transistor, and a gate electrode directly connected to a second scan line;

a fourth transistor including a first electrode directly connected to the gate electrode of the first transistor, a second electrode, and a gate electrode connected to the second scan line;

a fifth transistor including a first electrode connected to the second electrode of the first transistor, a second electrode connected to a fourth power source, and a gate electrode connected to a third scan line;

a sixth transistor including a first electrode connected to the gate electrode of the first transistor, a second electrode connected to the second electrode of the second transistor, and a gate electrode connected to a first emission control line;

a first capacitor connected between the second electrode of the first transistor and the second electrode of the fourth transistor;

a second capacitor connected between the second electrode of the second transistor and the second electrode of the fourth transistor; and a seventh transistor including a first electrode connected to a first power source, a second electrode connected to the first electrode of the first transistor, and a gate electrode connected to a second emission control line;

wherein the gate electrode of the first transistor connects the second electrode of the third transistor and the first electrode of the fourth transistor, wherein the first capacitor is directly connected to the second electrode to the first transistor.

15. The pixel unit of claim 14, wherein the first through seventh transistors are P-type thin film transistors, a gate-on voltage has a logic low level, and a gate-off voltage has a logic high level.

16. The pixel unit of claim 14, wherein the fourth transistor has a same effective electrical polarity as the third transistor.

17. A display device comprising:

pixels connected to a first scan line, a second scan line, a third scan line, a data line, a first emission control line, and a second emission control line, wherein each of the pixels comprises:

a light emitting element;

a first transistor connected between a first node coupled to a first power source and a second node coupled to an anode of the light emitting element, and including a gate electrode connected to a third node;

a second transistor connected between the data line and a fourth node, and including a gate electrode connected to the first scan line;

a first capacitor connected between the second node and a fifth node;

a second capacitor connected between the fourth node and the fifth node;

a third transistor connected between the third node and a third power source, and including a gate electrode directly connected to the second scan line;

a fourth transistor connected between the third node and the fifth node; including a gate electrode connected to the second scan line;

a fifth transistor connected between the second node and a fourth power source, and including a gate electrode connected to the third scan line; and a sixth transistor connected between the third node and the fourth node, and including a gate electrode connected to the first emission control line, wherein the third transistor and the fourth transistor are maintained in a turned-on state during an initialization period in which the second node is initialized by the fourth power source and the fifth node is initialized by the third power source, a compensation period in which a threshold voltage of the first transistor is compensated, and a data writing period in which a data voltage applied through the data line is supplied to the third node, and wherein the fifth transistor is turned on during the initialization period.

18. The display device of claim 17, further comprising:

a fifth transistor connected between the second node and a fourth power source, and including a gate electrode connected to the third scan line;

a seventh transistor connected between the first node and the first power source, and including a gate electrode connected to the second emission control line;

a non-emission period including the initialization period in which the second node is initialized by the fourth power source and the fifth node is initialized by the third power source, the compensation period in which a threshold voltage of the first transistor is compensated, and the data writing period in which a data voltage applied through the data line is supplied to the third node; and an emission period in which the light emitting element emits light in response to the data voltage, wherein each transistor that is connected between two elements is switchably connected between said elements through its controlled electrodes, wherein the third transistor and the fourth transistor are maintained in a turned-on state during the initialization period, the compensation period, and the data writing period, wherein the fifth transistor is turned on during the initialization period.

* * * * *